US006113212A

United States Patent [19]

Ng

[11] Patent Number: 6,113,212

[45] Date of Patent: Sep. 5, 2000

[54] METHOD AND APPARATUS FOR THERMAL CONTROL OF LED PRINTHEADS

[75] Inventor: Yee Seung Ng, Fairport, N.Y.

[73] Assignee: Eastman Kodak Company, Rochester, N.Y.

[21] Appl. No.: 09/061,774

[22] Filed: Apr. 16, 1998

[51] Int. Cl.[7] ..... B41J 29/377

[52] U.S. Cl. ..... 347/18; 347/223

[58] Field of Search ..... 347/18, 223, 117; 165/104.33

[56] References Cited

U.S. PATENT DOCUMENTS

| | | | |
|---|---|---|---|
| 4,728,981 | 3/1988 | Koek et al. | 355/1 |
| 5,177,500 | 1/1993 | Ng | 347/245 |
| 5,192,958 | 3/1993 | Charnitski | 347/242 |
| 5,231,423 | 7/1993 | Wataya et al. | 347/18 |
| 5,343,227 | 8/1994 | Hirosawa et al. | 347/18 |
| 5,374,944 | 12/1994 | Janosky et al. | 347/223 |
| 5,389,953 | 2/1995 | Agar et al. | 347/5 |
| 5,451,989 | 9/1995 | Kadowaki et al. | 347/18 |
| 5,486,849 | 1/1996 | Miura et al. | 347/18 |
| 5,512,924 | 4/1996 | Takada et al. | 347/18 |
| 5,631,676 | 5/1997 | Karz | 347/18 |

FOREIGN PATENT DOCUMENTS 0 629 508 A2 6/1994 European Pat. Off. .

*Primary Examiner*—William J. Royer
*Attorney, Agent, or Firm*—Norman Rushefsky

[57] ABSTRACT

An image recording apparatus and method includes a plurality of printheads and a plurality of heat exchangers. Each of the heat exchangers is thermally coupled with a respective one of the printheads. A preferred heat exchanger is a heat pipe wherein a cooling medium is circulated through each heat pipe. A flexible thermal link connects each of the heat exchangers with another of the heat exchangers to facilitate flexibility in mounting of the heat exchangers relative to each other.

23 Claims, 4 Drawing Sheets

METHOD AND APPARATUS FOR THERMAL CONTROL OF LED PRINTHEADS

FIELD OF THE INVENTION

The present invention is related to printing systems incorporating light emitting printheads as the imager, and more particularly, to a print system using LED printheads which are compensated for changes in length due to temperature variations.

BACKGROUND OF THE INVENTION

Image printheads used in xerographic recording systems are well known in the art. The printhead generally includes a linear array of a plurality of discrete light emitting sources optically coupled to a linear lens array. Light emitting diode (LED) arrays are preferred for many recording applications. In order to achieve high resolution, a large number of light emitting diodes (LEDs) are arranged in a linear array and means are included for providing a relative movement between the linear array and the photoreceptor so as to produce a scanning movement of the linear array over the surface of the photoreceptor. Thus, the photoreceptor may be exposed to provide a desired image one line at a time as the LED array and associated lens array is advanced relative to the photoreceptor either continuously or in stepping motion. Each LED pixel in the linear array is used to expose a corresponding area on the photoreceptor to a value determined by image defining video data information. Where the LEDs are arranged in a row at say 600 LEDs to the inch approximately 5000 LEDs may be present upon a printhead.

In a color xerographic system, as described U.S. Pat. No. 5,192,958, a plurality of LED printheads may be positioned adjacent the photoreceptor surface or photoconductor and selectively energized to create successive image exposures, one for each of the three basic colors. A fourth print bar may be added if black images arc to be created as well.

The arrays are addressed by video image signals whose application is controlled by a control circuit. Each array is optically coupled to focus the emitter outputs to form three spaced latent images on the surface of a photoreceptor belt. The optical coupling is accomplished by a plurality of gradient index lens arrays; the lens array sold under the name SELFOC™ a trademark of Nippon Sheet Glass Co., Ltd. Upstream of each exposure station, a charge device places a predetermined charge on the surface of the belt. Downstream from each exposure station, a development system develops a latent image of the last exposure without disturbing previously developed images.

With such a system as that disclosed, each colored image must be precisely aligned such that all corresponding pixels in the image areas are registered. The printhead alignment requirements are that the LEDs of each printhead must be aligned in the main scan or X-direction so that each active write length is equal. The printhead must also be aligned in the skew or Y-direction and in the Z-direction (tilt). This alignment must be maintained through continuous revolutions (passes) of the photoreceptor.

To maintain exact color registration of each image, the overall length of the write area, the pixel to pixel placement, and the straightness of the image line must all be within the required exacting tolerance.

A specific problem in correcting exact image-to-image registration, which is addressed by the prior art, is the change in length that an LED array undergoes when subjected to temperature increases, which are caused either by heat generated internally to the array, or by heat absorbed by the array from surrounding machine environment.

Typically, accurate LED arrays are made on a single ceramic substrate. To achieve proper registration, according to the prior art, the temperature of all LED arrays used in the printhead is allowed to vary over a relatively large temperature range. The technique described in the prior art is to keep them all at the "same" temperature. This way, the overall write length of the arrays will increase or decrease at the same time and at the same rate, thus achieving individual registration at every pixel.

The prior art accomplishes this objective by employing a manifold subframe that is adapted to securely mount plural printheads in parallel and perpendicular alignment. The subframe has apertures therethrough for circulating a cooling medium through the subframe and through the interior of arrays, the circulating medium maintains the arrays and the subframe at the same temperature.

A problem with the approach suggested in the prior art is that in coupling all the printheads rigidly to the manifold subframe, no ability is provided to adjust the LED print bars in the Y and Z directions which are perpendicular to the X direction. Thus registration of color separation images can be a problem with the approach suggested by the prior art.

SUMMARY OF THE INVENTION

In accordance with a first aspect of the invention, there is provided an image recording apparatus comprising a plurality of printheads; a plurality of heat exchangers, each of said heat exchangers being thermally coupled with a respective one of said printheads; and a flexible thermal link connecting each of said heat exchangers with another of said heat exchangers to facilitate flexibility in mounting of the heat exchangers relative to each other.

In accordance with a second aspect of the invention, there is provided an image recording apparatus comprising a plurality of printheads; a plurality of heat pipes, each of said heat pipes being associated with a respective one of said printheads for removing heat from the respective printhead; and a mount for each of the printheads to permit separate adjustable mounting in the X, Y and Z planes relative to each of the other printheads.

In accordance with a third aspect of the invention, there is provided a method of controlling heat in a recording apparatus that includes a plurality of printheads, the method comprising circulating a cooling medium through each of plural independent heat pipes, each associated with a respective one of the printheads; and cooling a terminal portion of each of the heat pipes with a respective heat exchanger that is thermally linked to a heat exchanger used to cool a terminal portion of a heat pipe associated with another of said plurality of printheads.

BRIEF DESCRIPTION OF THE DRAWINGS

Other aspects of the present invention will become apparent as the following description proceeds and upon reference to the drawings in which.

DETAILED DESCRIPTION OF THE PREFERRED EMBODIMENT

Because electrophotographic reproduction apparatus are well known, the present description will be directed, in particular, to elements forming part of, or cooperating more directly with, the present invention. Apparatus not specifically shown or described herein are selectable from those known in the prior art.

Figure 1:
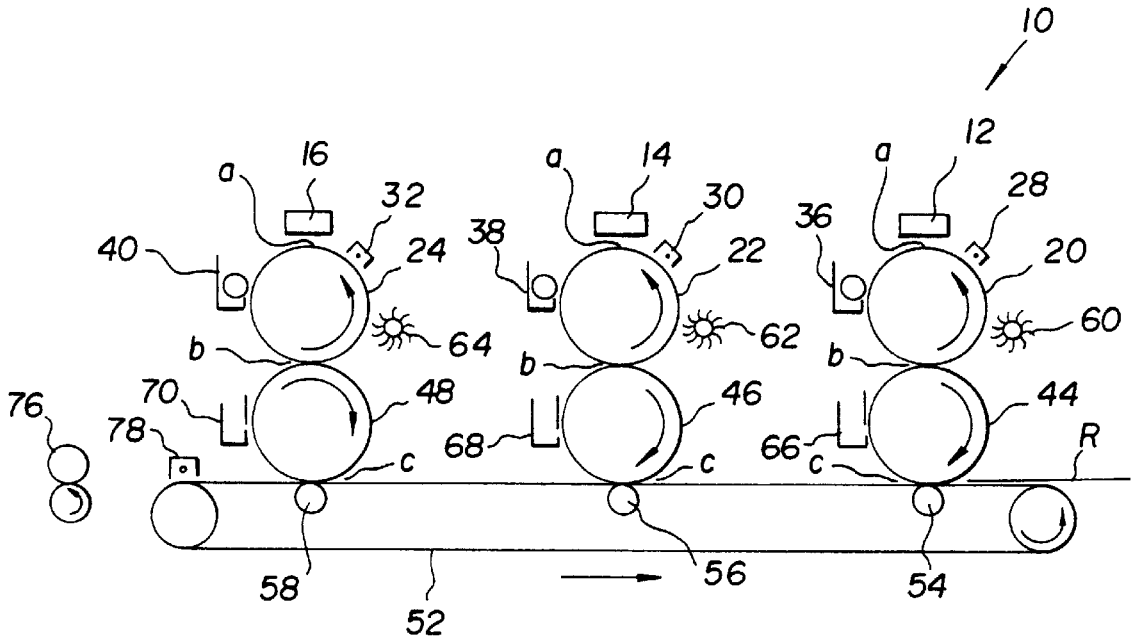
Fig. 1 (PRIOR ART)
FIG. 1 is a schematic of a color electrophotographic reproduction apparatus as known in the prior art.

With reference to FIG. 1, there is illustrated a schematic of a color reproduction apparatus 10 comprising a tandem machine having three LED writing units 12, 14 and 16. Each LED writer is an LED printhead that forms a latent electrostatic image on a respective uniformly charged rotating primary imaging member shown in the form of a photoconductive drum 20, 22 and 24, respectively, although they may also be in the form of a belt or web. A respective primary charger 28, 30, and 32 is associated with each primary imaging member for depositing a uniform electrostatic charge to the respective member. The selective energization of the LEDs on a respective primary imaging member imagewise modulates the charge at points "a" to form a latent electrostatic image thereon which is developed by a development station 36, 38 and 40, respectively, having a respective color toner. The LEDs on each printhead are imagewise modulated with image data representing a respective color separation record of the color information to be recorded as is well known. The developed color images are then transferred at respective nips "b" to respective intermediate transfer members such as drums 44, 46 and 48 under appropriate electrical bias. The intermediate transfer members (ITMs) may be belts or webs in lieu of drums. The respective developed colored separation images are then transferred in registered superposition to a receiver sheet R transported by a belt 52. A suitable electrical bias is provided by back-up rollers 54, 56 and 58 to transfer the respective color separation images in a nip "C" formed between the belt and the respective ITM. The receiver sheet moves serially into each of the nips "C" to receive the individual toner color separation images in registered superposition. The receiver sheet is then detacked from belt 52 using, for example, a detack charger 78 and then advanced into the nip of a pair of fuser rollers 76 which fuse or fix the toned images to the receiver sheet to form a multicolor image. The photoreceptor 20, 22 and 24 may then be cleaned at respective cleaning stations 60, 62 and 64, and reused for forming the next image. Similarly, the ITMs 44, 46 and 48 are cleaned at respective cleaning stations 66, 68 and 70 after transfer of the respective color separation image to the receiver sheet. A more detailed description of the general arrangement of such an apparatus is described in Tombs et al in U.S. application Ser. No. 08/900,696, the contents of which are incorporated herein by reference. Additional color stations beyond three may also be provided.

Figure 2:
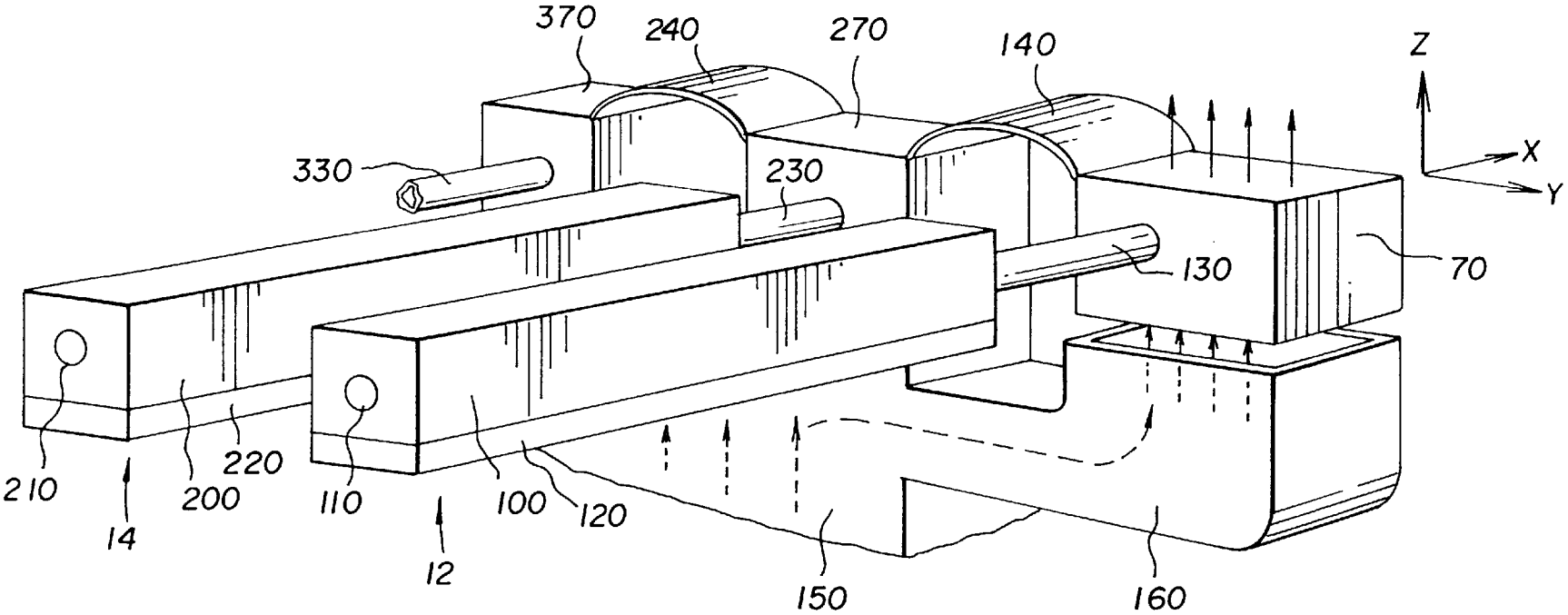
FIG. 2 is a perspective view of two LED printheads used in the apparatus of the invention including respective heat pipes and heat sink cooling blocks.
Figure 3:
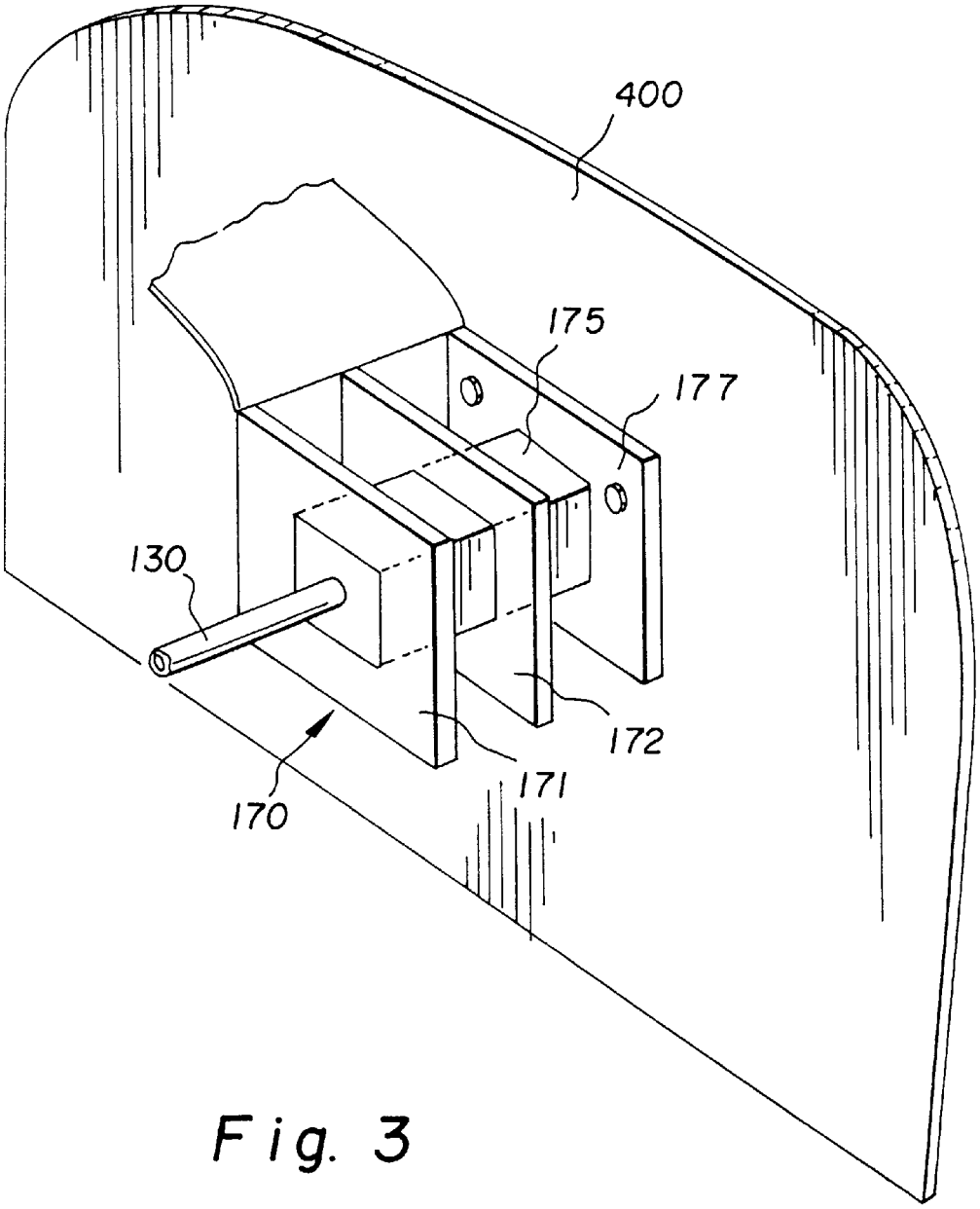
FIG. 3 is a perspective view of the heat sink cooling block shown in FIG. 2.

With reference now to FIGS. 2 and 3, a pair of LED printheads 12, 14is illustrated in schematic form (FIG. 2) each of which is exemplary of the LED writers of FIG. 1.

Printheads 12, 14 include each a metal block 100, 200 respectively which serves as a heatsink for conducting heat from the ceramic substrate 120, 220 respectively and stabilizing the temperature of the respective printhead. Each block 100, 200 respectively has extending through the length thereof a heat pipe 110, 220 which connects through a respectively flexible connecting portion 130, 230 to a terminal heat pipe portion 175 that is formed within an air cooling section 170. Upon the ceramic substrate 120, 220 as is well known, there is mounted a series of driver chips and LED chip arrays (not shown). The driver chips and LED chip arrays are adhesively connected to the ceramic substrate preferably with adhesives that provide good thermal conductivity. The LED chip arrays extend in a row (x-direction) along the length of each printhead. Driver chips are provided to each side of each LED chip array. Each LED chip array may have 128 or 196 LEDs and there may be 5000 or more LEDs mounted on the printhead at a spacing of say 1/600 inches. Descriptions of LED printheads are provided in the prior art, for example, U.S. Pat. No. 5,389,953 and commonly assigned U.S. application Ser. No. 08/581,025. The ceramic substrate is also a good conductor of heat and is in intimate contact with the metal block but preferably not adhesively connected to allow the ceramic block with the chips thereon to be removed and repaired or replaced. Various connectors well known in the art and not shown may be provided for mechanically connecting the ceramic substrate to the metal block.

The heat pipe operates according to well known principles. Specifically, a working fluid in the heat pipe evaporates and then flows from the heated region to the cooler end or region through an evacuated chamber. At the cooler region, the vapor condenses giving up its heat of evaporation. The condensed fluid then returns to the previously heated region by means of capillary action or gravity. This process is repeated along the length of the heat pipe to maintain the temperature of the printhead substantially uniform along the length thereof.

In the cooling sections 170, 270, 370 a series of metal fins 171, 172 (many others are also provided but not shown, not shown also are the fins of cooling sections 270 and 370) are in thermal contact with each terminal heat pipe portion 175 of the heat pipe. Cooling air is blown through a plenum system 150 having a respective plenum segment or duct 160 associated with each cooling section 170, 270, 370. In FIG. 2, structure associated with printhead 14 is identical to that described with reference to printhead 12 and corresponding structure is identified with a part number that has one hundred added to it. Only portions of structure are shown associated with printhead 12 and showing cooling section 370 and flexible connecting portion 330. Corresponding structure to that of printhead 12 is identified with a part number that has two hundred added to it. Thus, each duct provides cooling air from the same cooling air source to a respective cooling section. The cooling sections are further thermally linked by braided thermal conductors 140, 240. This braided thermal conductive material is commercially available and is in the form of a flexible sheet, ribbon, wire or rope and is comprised of metal fibers or wires that are woven together. Thus, substantial uniformity of temperature is provided for by thermally linking the cooling sections. In addition to having the various printheads thermally linked to be at least the same temperature, the advantages of the structure provided over that of the prior art is that the printheads each can be mounted for movement relative to each other and their respective cooling sections to facilitate exact placement of each printhead in the X, Y, and Z planes relative to the photoreceptor. This allows for correction of skew of the printhead relative to the photoreceptor to thus eliminate or reduce one of the more objectionable recording problems.

Figure 5:
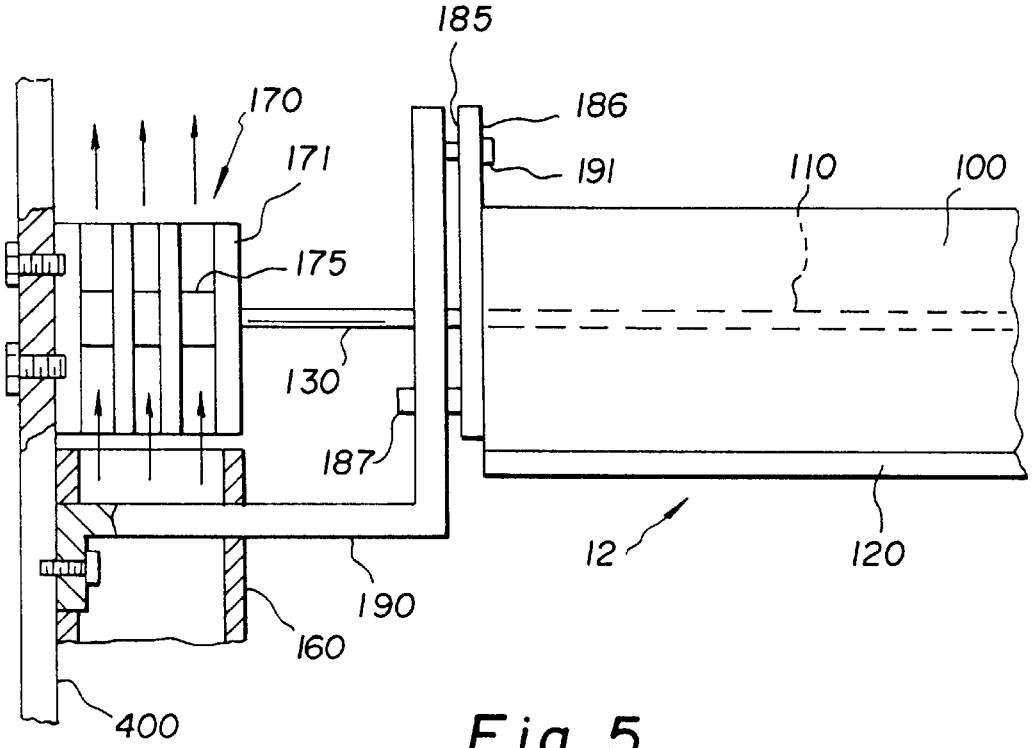
FIG. 5 is a side elevation view of a printhead of FIG. 2 and showing mounting of one end of the printhead to a bracket assembly.
Figure 4:
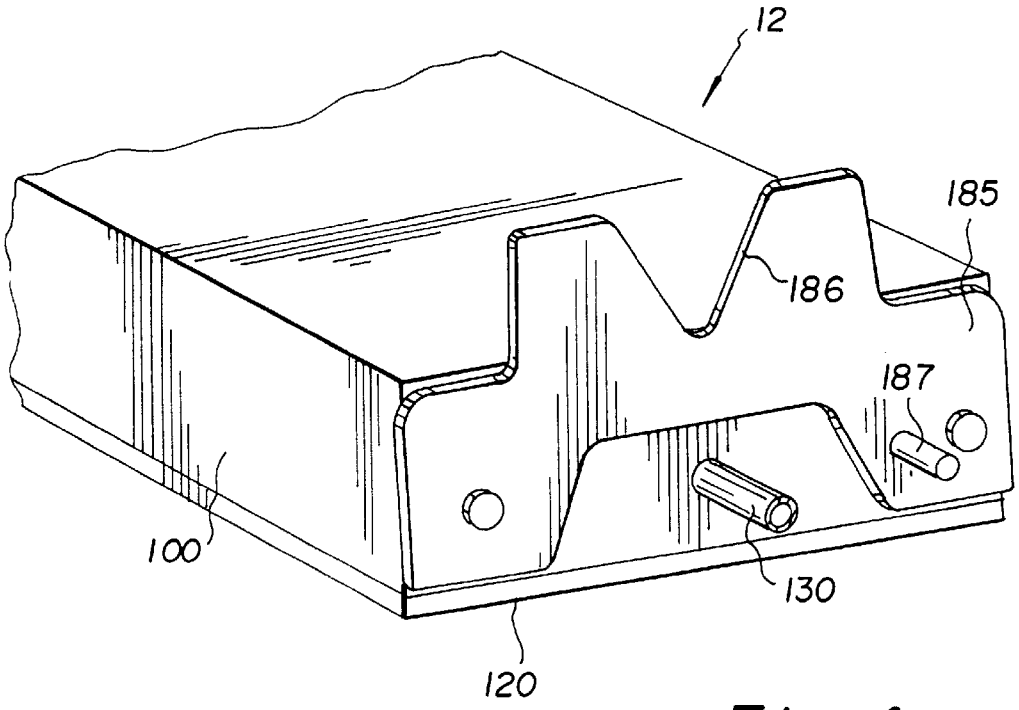
FIG. 4 is a perspective view of one end of a printhead shown in FIG. 2.

With reference to FIGS. 4 and 5, each printhead has an endplate 185 with mounting structure suitable for locating that end of the printhead on a respective mounting bracket 190 connected to and projecting from the machine frame 400. The mounting bracket includes adjustable cooperating structure for accurately locating the printhead. One adjustable structure may be a round pin 191 that is attached to the bracket 190 and extends therefrom to seat within and engage both legs of the V-shaped locating structure 186. A round pin 187 is fixed to end plate 185 and is engaged in an opening in the end plate. A hook, not shown, may be provided to engage pin 187 and urge the pin upwardly to support this end of the printhead. Corresponding structure may be provided at the other end of the printhead. In regard to structure for mounting of printheads to control accurate positioning thereof reference may be had to U.S. Pat. No. 4,728,981.

In lieu of heat pipes, actively controlled thermal electric coolers (at a similar temperature setpoint) that share a commonly linked heat sink may also be used.

Although the invention is described with reference to an electrostatographic reproduction apparatus having separate photoreceptors, the invention is also applicable to where the writers record on the same photoreceptor. In addition, the invention is also applicable to recording on photographic film using LEDs having different respective light outputs (wavelengths). The invention is also applicable to inkjet and thermal recording as well as other types of recording wherein plural relatively long recording arrays require temperature to be made constant for the various arrays.

There has thus been provided an improved apparatus and method for thermal control of plural printheads that allows each the flexibility of being mounted relative to the other printheads by the use of flexible connections.

The invention has been described in detail with particular reference to certain preferred embodiments thereof, but it will be understood that variations and modifications can be effected within the spirit and scope of the invention.

Parts List

Printhead 12, 14, 16
Photoreceptor 20, 22,24
Primary Charger 28, 30, 32
Development or toning station 36, 38, 40
ITM 44, 46, 48
Belt 52
Back-up roller 54, 56, 58
Cleaning station 60, 62, 64, 66, 68, 70
Fuser 76
Detack charger 78
Nips a, b, c
Metal block 100, 200
Heat pipe 110, 210
Ceramic substrate 120, 220
Heat pipe flexible connection portion 130, 230, 330
Flexible thermal coupling 140, 240
Plenum assembly 150
Plenum segment or duct 160
Cooling section or heat exchanger 170, 270, 370
Fin 171
Fin 172
Cool end of heat pipe 175
Mounting plate of cooling section 177
End plate 185
V-shaped groove 186
Locating pin 187
Pin 191
Machine frame 400

What is claimed is:

1. An image recording apparatus comprising:

a plurality of printheads;

a plurality of heat exchangers, each of said heat exchangers being thermally coupled with a respective one of said printheads; and a flexible thermal link connecting each of said heat exchangers with another of said heat exchangers to facilitate flexibility in mounting of the heat exchangers relative to each other.

2. The apparatus of claim 1 and including a supply of air for moving air through said heat exchangers.

3. The apparatus of claim 2 wherein the air is delivered to all said heat exchangers from a common plenum.

4. The apparatus of claim 1 wherein each printhead is coupled to a heat exchanger through a flexible coupling to permit for accurate location of the printhead relative to a photoreceptor.

5. The apparatus of claim 4 wherein the printheads each include a plurality of light-emitting diodes.

6. The apparatus of claim 1 and including a plurality of heat pipes, each of said heat pipes being associated with a respective one of said printheads for removing heat from the respective printhead and a terminal portion of each of the heat pipes being located within a respective one of said heat exchangers.

7. The apparatus of claim 6 and including a mount for each of the printheads to permit separate adjustable mounting of a printhead in the X, Y, and Z planes relative to each of the other printheads.

8. The apparatus of claim 1 and including a mount for each of the printheads to permit separate adjustable mounting of a printhead in the X, Y, and Z planes relative to each of the other printheads.

9. An image recording apparatus comprising:

a plurality of printheads;

a plurality heat pipes, each of said heat pipes being associated with a respective one of said printheads for removing heat from the respective printhead;

a mount for each of the printheads to permit separate adjustable mounting of a printhead in the X, Y and Z planes relative to each of the other printheads;

a plurality of heat exchangers, each of said heat exchangers being thermally coupled with a respective one of said printheads; and a flexible thermal link connecting each of said heat exchangers with another of said heat exchangers to facilitate flexibility in mounting of the heat exchangers relative to each other.

10. The apparatus of claim 9 and including a supply of air for moving air through said heat exchangers.

11. The apparatus of claim 10 wherein the air is delivered to all said heat exchangers from a common plenum.

12. The apparatus of claim 9 wherein each printhead is coupled to a heat exchanger through a flexible coupling to permit for accurate location of the printhead relative to a photoreceptor.

13. The apparatus of claim 9 wherein the printheads each include a plurality of light-emitting diodes.

14. A method of controlling heat in a recording apparatus that includes a plurality of printheads, the method comprising:

circulating a cooling medium through each of plural independent heat pipes, each associated with a respective one of the printheads;

cooling a terminal portion of each of the heat pipes with a respective heat exchanger that is thermally linked to a heat exchanger used to cool a terminal portion of a heat pipe associated with another of said plurality of printheads; and mounting the printheads in the apparatus so that each printhead is separately adjusted in the X, Y and Z planes relative to the other printheads.

15. The method of claim 14 and including moving air through said heat exchangers.

16. A method of controlling heat in a recording apparatus that includes a plurality of printheads, the method comprising:

circulating a cooling medium through each of plural independent heat pipes, each associated with a respective one of the printheads;

cooling a terminal portion of each of the heat pipes with a respective heat exchanger that is thermally linked to a heat exchanger used to cool a terminal portion of a heat pipe associated with another of said plurality of printheads; and wherein thermal linking to the heat exchanger is provided by a flexible link.

17. The method of claim 16 and including mounting the printheads in the apparatus so that each printhead is separately adjusted in the X, Y and Z planes relative to the other printheads.

18. A method of controlling heat in a recording apparatus that includes a plurality of printheads, the method comprising:

circulating a cooling medium through each of plural independent heat pipes, each associated with a respective one of the printheads;

cooling a terminal portion of each of the heat pipes with a respective heat exchanger that is thermally linked to a heat exchanger used to cool a terminal portion of a heat pipe associated with another of said plurality of printheads; and including mounting the printheads in the apparatus so that each printhead is separately adjusted to reduce skew with a recording member.

19. A method of adjusting positions of heat exchangers in an image recording apparatus comprising:

supporting a plurality of printheads in the apparatus;

providing a plurality of heat exchangers in the apparatus, each of said heat exchangers being thermally coupled with a respective one of said printheads;

providing a flexible thermal link connecting each of said heat exchangers with another of said heat exchangers; and adjusting positions of the heat exchangers relative to each other while using flexibility of the thermal link connecting each heat exchanger to another of said heat exchangers to permit for separate adjustment of the positions of the heat exchangers relative to each other.

20. The method of claim 19, wherein each printhead is coupled to a heat exchanger through a flexible coupling to permit for accurate location of the printhead relative to a photoreceptor.

21. The method of claim 19 and including providing a plurality of heat pipes, each of said heat pipes being associated with a respective one of said printheads for removing heat from the respective printhead and a terminal portion of each of the heat pipes being located within a respective one of said heat exchangers.

22. The method of claim 21 and including providing a mount for each of the printheads and separately adjusting mounting of a printhead in the X, Y, and Z planes relative to each of the other printheads.

23. The method of claim 19 and including providing a mount for each of the printheads and separately adjusting mounting of a printhead in the X, Y, and Z planes relative to each of the other printheads.

* * * * *